US007387153B2

(12) United States Patent
Ramirez

(10) Patent No.: US 7,387,153 B2
(45) Date of Patent: Jun. 17, 2008

(54) CENTRIFUGATION INJECTION MOLD

(75) Inventor: Rivio Arturo Ramirez, Joinville-Sc (BR)

(73) Assignee: Empresa Brasileira De Compressores S.A. - Embraco, Joinville-SC (BR)

( * ) Notice: Subject to any disclaimer, the term of this patent is extended or adjusted under 35 U.S.C. 154(b) by 538 days.

(21) Appl. No.: 10/510,670

(22) PCT Filed: May 15, 2003

(86) PCT No.: PCT/BR03/00064

§ 371 (c)(1),
(2), (4) Date: Dec. 17, 2004

(87) PCT Pub. No.: WO03/097274

PCT Pub. Date: Nov. 27, 2003

(65) Prior Publication Data

US 2006/0013907 A1 Jan. 19, 2006

(30) Foreign Application Priority Data

May 17, 2002 (BR) ..... 0202033

(51) Int. Cl.
*B22D 13/00* (2006.01)
*B22D 19/00* (2006.01)

(52) U.S. Cl. ..... 164/286; 164/288; 164/292; 425/127

(58) Field of Classification Search ..... 164/114, 164/286, 288–290, 292, 296; 264/310–312; 425/127–129.1
See application file for complete search history.

(56) References Cited

U.S. PATENT DOCUMENTS 2,381,616 A 8/1945 Pfleger
2,996,773 A 8/1961 Summers
6,997,236 B2 * 2/2006 Ramirez et al. ..... 164/286

* cited by examiner

*Primary Examiner*—Kuang Lin
(74) *Attorney, Agent, or Firm*—Darby & Darby P.C.

(57) ABSTRACT

A centrifugation injection mold comprising: a lower mold portion having a basic block the lower portion of which is mounted to and rotates within bearing means that are affixed to a machine structure, a plurality of axial columns the bottom portions of which are affixed around the outer portions of the basic block, and a moveable block defining a lower mold cavity and being mounted in a sliding relationship to the axial columns, in order to be axially displaced between an open mold position and a closed mold position; an impelling means operatively associated with the machine structure and with the moveable block for displacing the moveable block to the open mold position against the action of an elastic means; a locking means mounted to each axial column; and an upper mold portion to be removably seated on the axial columns and affixed thereto by the locking means in a closed mold position.

11 Claims, 5 Drawing Sheets

CENTRIFUGATION INJECTION MOLD

CROSS REFERENCE TO PRIOR APPLICATION

This is a U.S. national phase application under 35 U.S.C. §371 of International Patent Application No. PCT/BR03/00064, filed May 15, 2003, and claims benefit of Brazilian Patent Application No. PI 0202033-5, filed May 17, 2002 which is incorporated by reference herein. The International Application was published in English on Nov. 27, 2003 as WO 03/097274 A2 under PCT Article 21(2).

FIELD OF THE INVENTION

The present invention refers to a two-piece mold used in the injection, by centrifugation, of the cage made of aluminum or other adequate material into the stack of steel laminations of the rotor of an electric motor, particularly the rotor of small electric motors, such as those used in the hermetic compressors of refrigeration systems.

BACKGROUND OF THE INVENTION

It is already known from the prior art the centrifugation injection of the aluminum cages in rotors, which are formed by a stack of overlapped annular steel laminations provided with openings that are longitudinally aligned with the openings of other laminations of the stack, in order to define a plurality of axial channels interconnecting the external faces of the end laminations of the stack and which are angularly spaced from each other along a circular alignment, which is concentric to the longitudinal axis of the lamination stack, but radially spaced back in relation to the lateral face of the latter.

The lamination stack, with the longitudinal axis vertically disposed, is positioned inside a mold which defines a lower annular cavity close to the external face of the lower end lamination, and an upper cavity, which is substantially cylindrical or frusto-conical, close to the external face of the upper end lamination and opened to the inlet channel for the admission of aluminum into the mold.

During the aluminum pouring, the lamination stack has its central axial bore, into which will be later mounted the shaft of the electric motor, filled with a core having an upper end substantially leveled with the upper end lamination of the lamination stack, and a widened lower end portion seated on a respective lower end widening of the central axial bore of the lamination stack and against the mold portion that defines the lower cavity.

The aluminum is poured into the upper cavity, passing through the axial channels of the lamination stack to the lower cavity, filling the latter, the axial channels and the upper cavity, in this order, solidifying in a radial inward upward pattern, as the mold rotates around its vertical axis and the metals cools.

Upon completion of the aluminum pouring and solidification, the mold is opened and the formed rotor is submitted to one or more operations to eliminate the inlet channel and unobstruct the adjacent end of the central axial bore of the lamination stack, and to define the correct internal profile for the upper ring of the aluminum cage, which further comprises in a single piece, a lower ring already formed by the mold, and a plurality of bars formed inside the axial channels of the lamination stack.

In the centrifugation injection of these rotors, the upper and lower cavities of the mold and the lamination stack itself are heated, so that the aluminum passes through the upper cavity and through the axial channels of the lamination stack without solidifying, by gravity reaching the lower cavity, filling it and starting to solidify from the outside to the inside, and from the bottom upwardly, while the mold remains rotating.

In order to allow the injection mold, which involves and locks the upper and lower portions of the lamination stack, to rotate around its vertical longitudinal axis, the upper and lower cavities of the mold are mounted, respectively, to an upper bearing and to a lower bearing that are carried by the structure of the injection equipment.

In the molds of the above mentioned type, the deviations of concentricity and parallelism that occur between the axes of the upper and lower cavities cause vibrations in the mold and in the lamination stack during the rotation of the mold, which vibrations actuate in the metallic material being solidified in the upper and lower cavities.

A major problem caused by said vibrations of the rotating mold during the solidification of the aluminum is that the bars of the cage, which are formed inside the axial channels of the lamination stack, and even the rings, tend to present cracks, the bars being transversally broken in the interior of the lamination stack in a manner not perceived by external visual observation of the finished rotor. The rupture or crack of one or more bars or of the upper and lower rings of the cage considerably impairs the quality of the rotor and consequently the efficiency of the electric motor to be formed.

One of the possibilities to minimize or even eliminate the loss of quality by undue vibrations of the mold during the solidification of the aluminum is to mount the two cavities of the mold on a single lower bearing, whereby the axes of the two mold parts are united. However, in this solution, the upper and lower cavities of the mold are guided by columns affixed to the lower cavity. The upper cavity is axially displaced, guided by the columns, to open and close the mold, whereby the upper cavity is retained in a sliding relationship with the columns, considerably limiting the automation of the operations of loading the lamination stack in the mold and extracting the centrifuged rotor, besides causing problems of concentricity and rotor strike.

While the mounting of the two mold cavities on a single lower bearing assembly allows eliminating the problem of cracks in the parts of the aluminum cage caused by deviations of concentricity and parallelism between the axes of the two mold cavities, this known prior art mold still maintains the upper mold cavity mounted to the columns which are axially and eccentrically projected from the lower cavity, when said upper mold cavity reaches the open mold position for the loading of the lamination stack or removal of the centrifuged rotor. Thus, the movement of the lamination stack in and out of the mold must be effected by passing the lamination stack radially through the gap formed between two consecutive columns. This characteristic of the solutions in which there is only one lower bearing and the upper cavity is axially displaced along the columns between the open and closed mold positions requires complex solutions to reach a high degree of automation in the production of the rotors with a short cycle time, impairing the productivity.

OBJECT OF THE INVENTION

Aiming at solving the deficiencies of the prior art centrifugation injection molds, in which the upper and lower mold cavities are mounted to a single lower bearing assembly and allowed to rotate therein, the present invention proposes a mold with a relatively simple and efficient construction, which assures the balanced rotation of the mold during the solidification of the cage in the lamination stack, avoiding vibrations and rupture of the component parts of the cage, particularly its bars, without limiting the access to the interior of the mold in the automatic operations of loading the lamination stack in the mold and extracting the centrifuged rotor.

SUMMARY OF THE INVENTION

The mold of the present invention is used in the injection, by centrifugation, of aluminum or other metallic alloy that is suitable to form several parts, such as the cage of the rotor of an electric motor used in hermetic compressors.

According to the invention, the mold comprises: a lower mold portion having a basic block, the lower portion of which is mounted to and allowed to rotate within bearing means that are affixed to the structure of a centrifugation injection machine; a plurality of axial columns, the bottom portions of which are affixed around the outer portions of the basic block, and a moveable block defining a lower mold cavity and being mounted to the axial columns in a sliding relationship, in order to be axially displaced between an open mold position and a closed mold position. Elastic means are seated on the basic block so as to constantly force the moveable block to the closed mold position. An impelling means is operatively associated with the machine structure and the moveable block and is selectively driven to displace the moveable block to the open mold position against the action of the elastic means. An upper mold portion is removably seated on the axial columns and affixed thereto by locking means in a closed mold position.

The constructive arrangement defined above allows for maintaining the two mold portions correctly positioned and aligned in the closed mold position by means of the axial columns, the mold being supported by only one assembly of bearings affixed to the machine structure and which support and allow the rotation of the lower mold portion. The upper mold portion is conducted to be engaged with the lower mold portion in a positioning that is guaranteed by the axial columns, which are rigidly and correctly affixed to the lower mold portion. This assembly eliminates the problem of the unaligned axes of the two mold portions.

Besides the above-mentioned aspect, the present construction allows the upper mold portion to be completely removed from the axial columns and spaced therefrom by means of a preferably robotized positioning device, whereby the product to receive the injection, for example the rotor of the electric motor, can be easily positioned inside the open mold, seated on the lower mold portion after being axially displaced downwards through the inside of the axial columns, independently of the angular position in which said axial columns are found in the lower mold portion.

BRIEF DESCRIPTION OF THE DRAWINGS

The invention will be described below, with reference to the enclosed drawings, in which.

DESCRIPTION OF THE ILLUSTRATED EMBODIMENT

Figure 1:
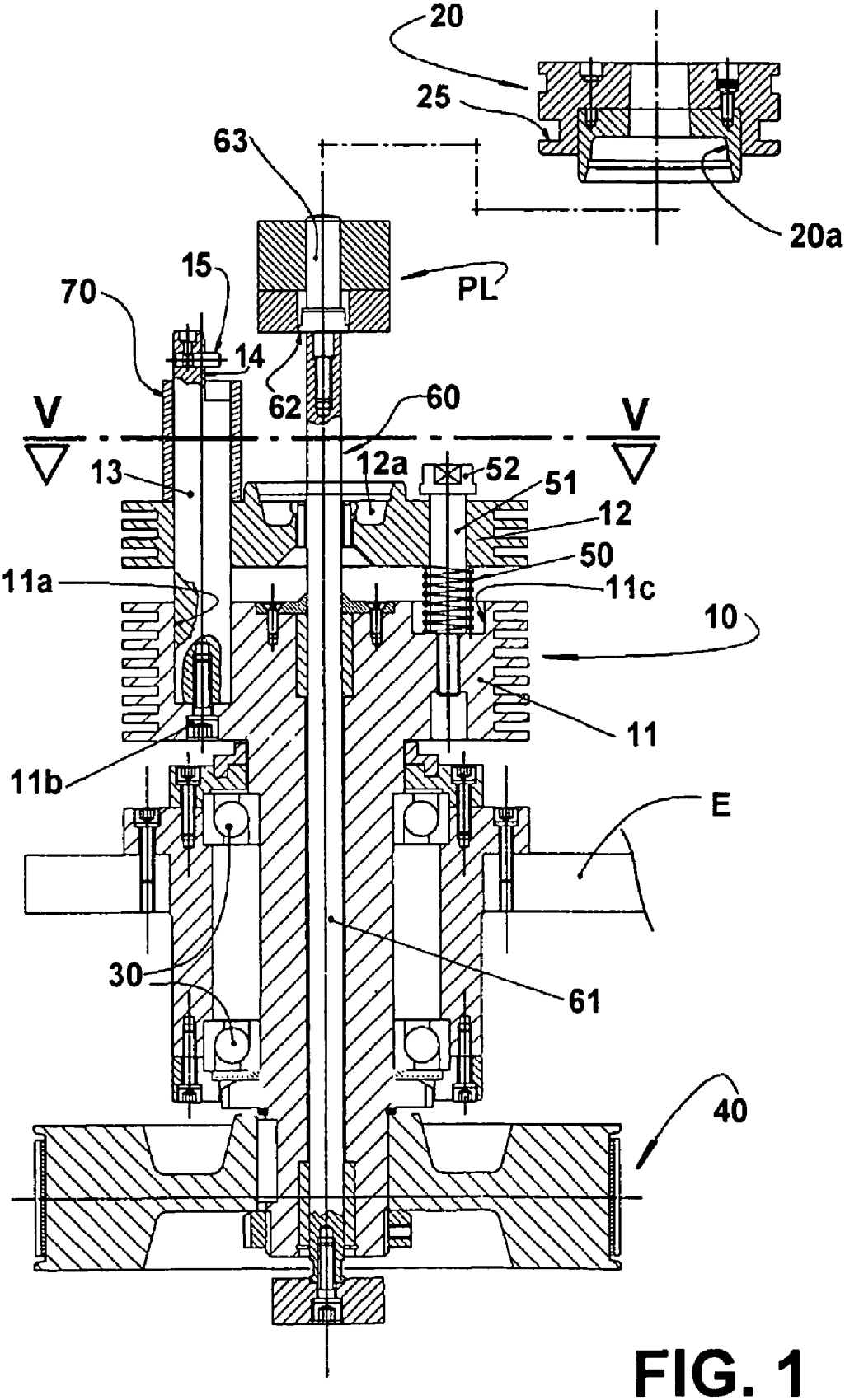
FIG. 1 is a simplified diametrical vertical sectional view of an injection mold in the open condition, with the upper mold portion being removed to allow a steel lamination stack to be received inside the mold of the present invention.

The figures of the enclosed drawings illustrate the mold used for the injection, by centrifugation, of an aluminum cage incorporated in a lamination stack of an electric motor rotor, this rotor construction being well known in the art. However, it should be understood that the present mold might be applied for the centrifugation injection of other parts that can be negatively affected by the misalignment that occurs between the mold parts during the solidification of the injected hot metal.

The illustrated mold comprises a lower mold portion 10 and an upper mold portion 20 which are coaxially displaced between open and closed mold positions, as described ahead.

The lower mold portion 10 presents a basic block 11 downwardly extended to be mounted onto bearing means 30 and allowed to rotate therein. The bearing means 30 are axially spaced from each other and affixed to a machine structure E, generally a machine structure for centrifugation injection. A lower end portion of the basic block 11 projects beyond the bearing means 30 to receive a pulley 40 to be operatively coupled, usually by attrition, to a driving unit (not illustrated) which is dimensioned to produce the rotation of the basic block 11 around its longitudinal axis, upon centrifugation of the molten metal being poured inside the closed mold. The basic block carries a plurality of upper peripheral axial columns 13 the lower portions of which are rigidly affixed to the basic block 11 by any adequate process, such as by being inserted into respective eccentric axial housings 11*a* of the basic block and axially locked by bolts 11*b*.

In the example illustrated in the figures, only one axial column 13 is shown, although three of these columns are provided equally and mutually spaced by 120°.

The lower mold portion 10 further comprises a moveable block 12 the top portion of which defines-a lower mold cavity 12*a* and which is mounted in a sliding relationship to the axial columns 13 so as to be axially displaced between an open mold position, in which it is approximated to the basic block 11, and a closed mold position, in which it is separated from the basic block 11.

As illustrated, the moveable block 12 is constantly forced to the closed mold position by action of a plurality of elastic means 50 generally in the form of helical springs, which are intercalated and parallel to the axial columns and have a lower end seated on a respective housing 11*c* provided in the basic block 11, and an upper end seated against the moveable block 12. The elastic means 50 are preferably mounted around respective axial rods 51. The bottom portions of the axial rods 51 are affixed to the basic block 11 and the axial rods 51 pass through the moveable block 12 in order to have their upper end incorporating a widened head 52, which operates as a stop means for limiting the maximum displacement of the moveable block 12 away from the basic block 11 by action of the elastic means 50 when the mold is open, with the upper mold portion 20 removed, and said mold prepared to receive the lamination stack PL therewithin, as illustrated in FIGS. 1-2.

Figure 4:
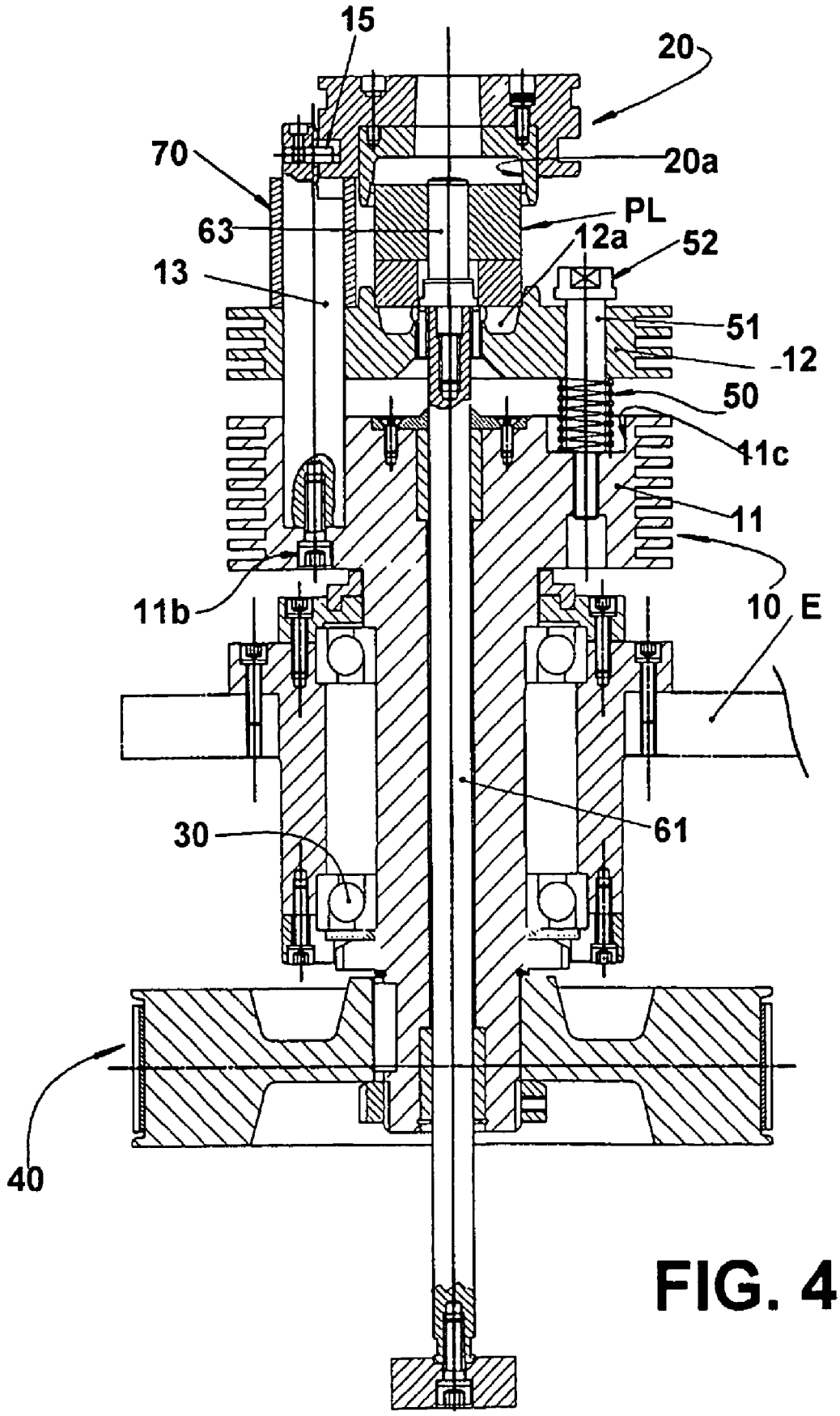
FIG. 4 is a view similar to that of FIG. 3, but illustrating the lower and upper mold portions in the closed mold position around the lamination stack.
Figure 5:
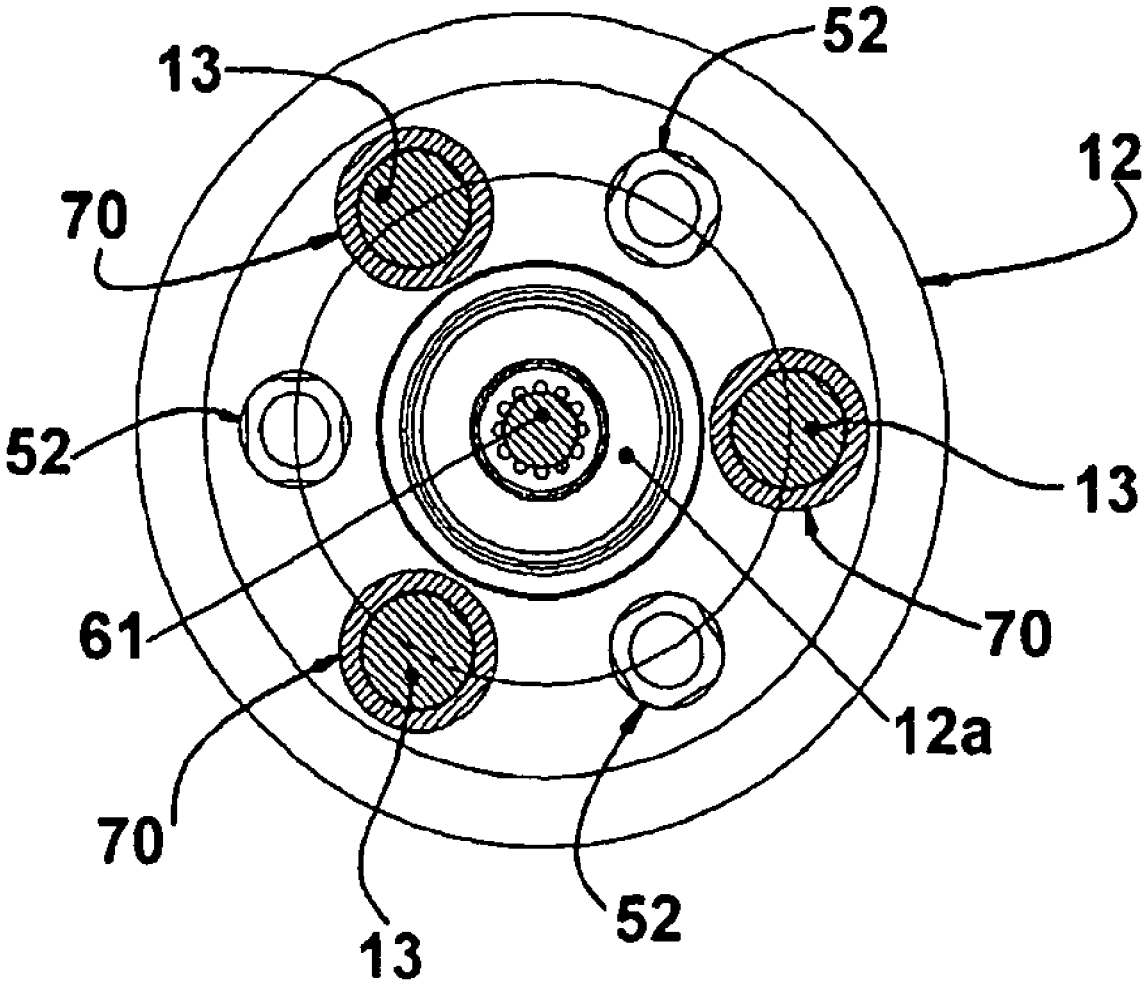
FIG. 5 is a cross-sectional view taken according to line V-V in FIG. 1.

As already described in relation to the axial columns 13, the elastic means 50 are generally three elastic means arranged according to the same circular alignment of the axial columns 13 and also circumferentially spaced from each other by 120°, although the figures of the drawings illustrate only one elastic means 50 and the respective axial rod 51. The bottom face of upper mold portion 20 defines an upper mold cavity 20*a* to be operatively associated with the lower mold cavity 12*a* upon the closing of the mold, in order to define a plenum to be filled with the liquid metal. In the illustrated example, the upper mold cavity 20*a* and the lower mold cavity 12*a* are respectively associated with the two opposite end faces of the lamination stack PL of an electric motor rotor, as illustrated in FIG. 4.

In the illustrated embodiment, the mold further comprises an impelling means 60, which is driven pneumatically or by any other adequate manner, comprising an elongated rod 61 axially passing through the basic block 11 and the moveable block 12 of the lower mold portion 10, said elongated rod 61 presenting an upper end provided with an annular flange 62 seated against the central region of the lower mold cavity 12*a*, and a lower end provided with means to be coupled to any driving device, not illustrated, which is capable of promoting the selective axial displacement of the elongated rod 61 through the lower mold portion 10. The upper end of the elongated rod 61 further incorporates an axial extension 63 disposed above the annular flange 62 and which is designed to fit inside the central bore of the lamination stack PL, in order to tightly and completely occupy the space defined by said bore, avoiding the admission of liquid metal in this region of the lamination stack PL.

Figure 2:
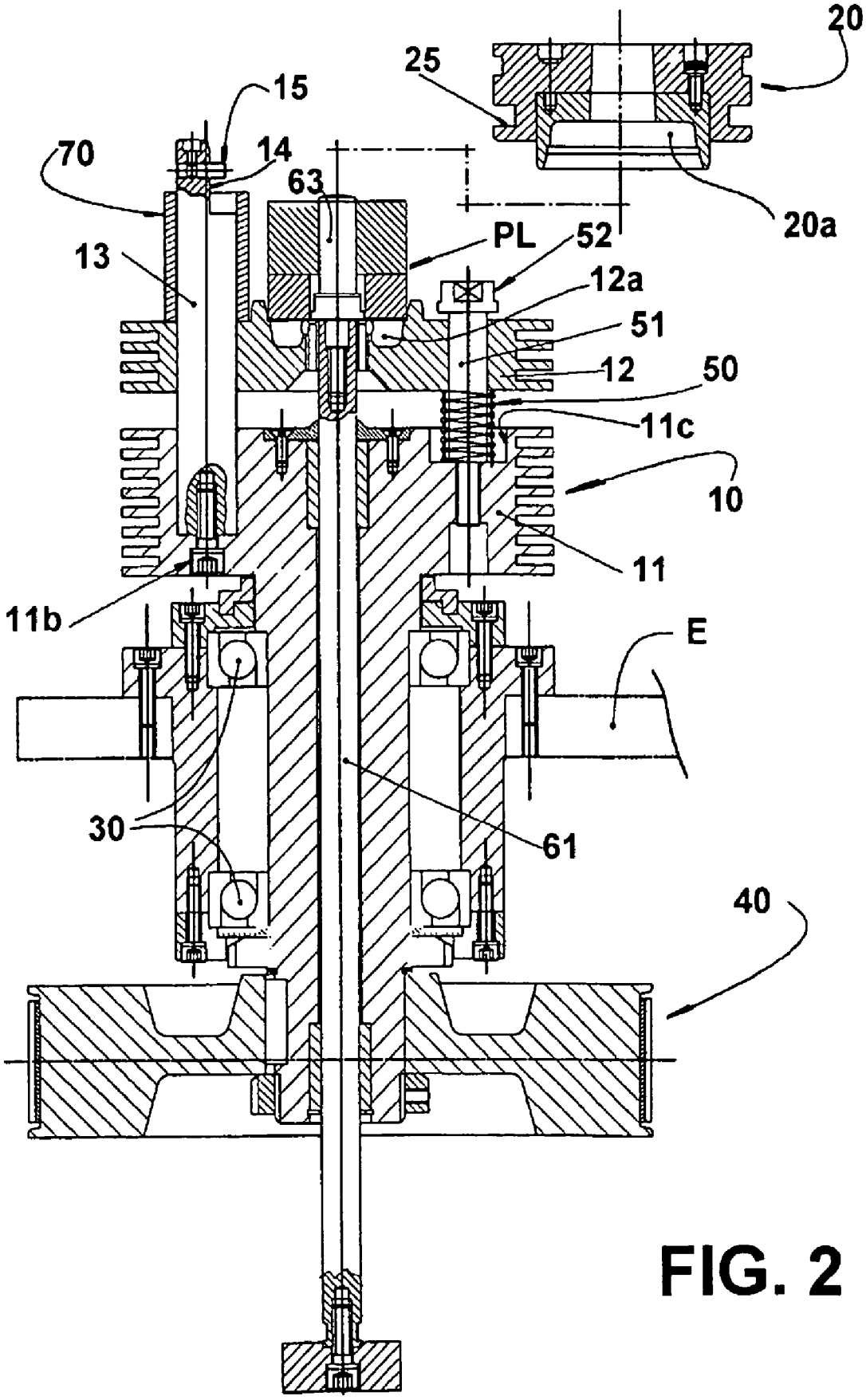
FIG. 2 is a view similar to that of FIG. 1, but illustrating the mold still open, but with the lamination stack seated on the lower mold portion.

As illustrated in FIG. 1, with the mold being open and the upper mold portion 20 removed, the impelling means 60 has its elongated rod 61 axially upwardly displaced to a loading/unloading position, allowing a lamination stack PL to be tightly fitted around but easily released from the axial extension 63 of the elongated rod 61.

Then, the elongated rod 61 is axially displaced downwards to the position illustrated in FIG. 2, in which the annular flange 62 is seated on the moveable block 12 of the lower mold portion 10, and the lower end face of the lamination stack PL is seated on the lower mold cavity 12*a*.

Figure 3:
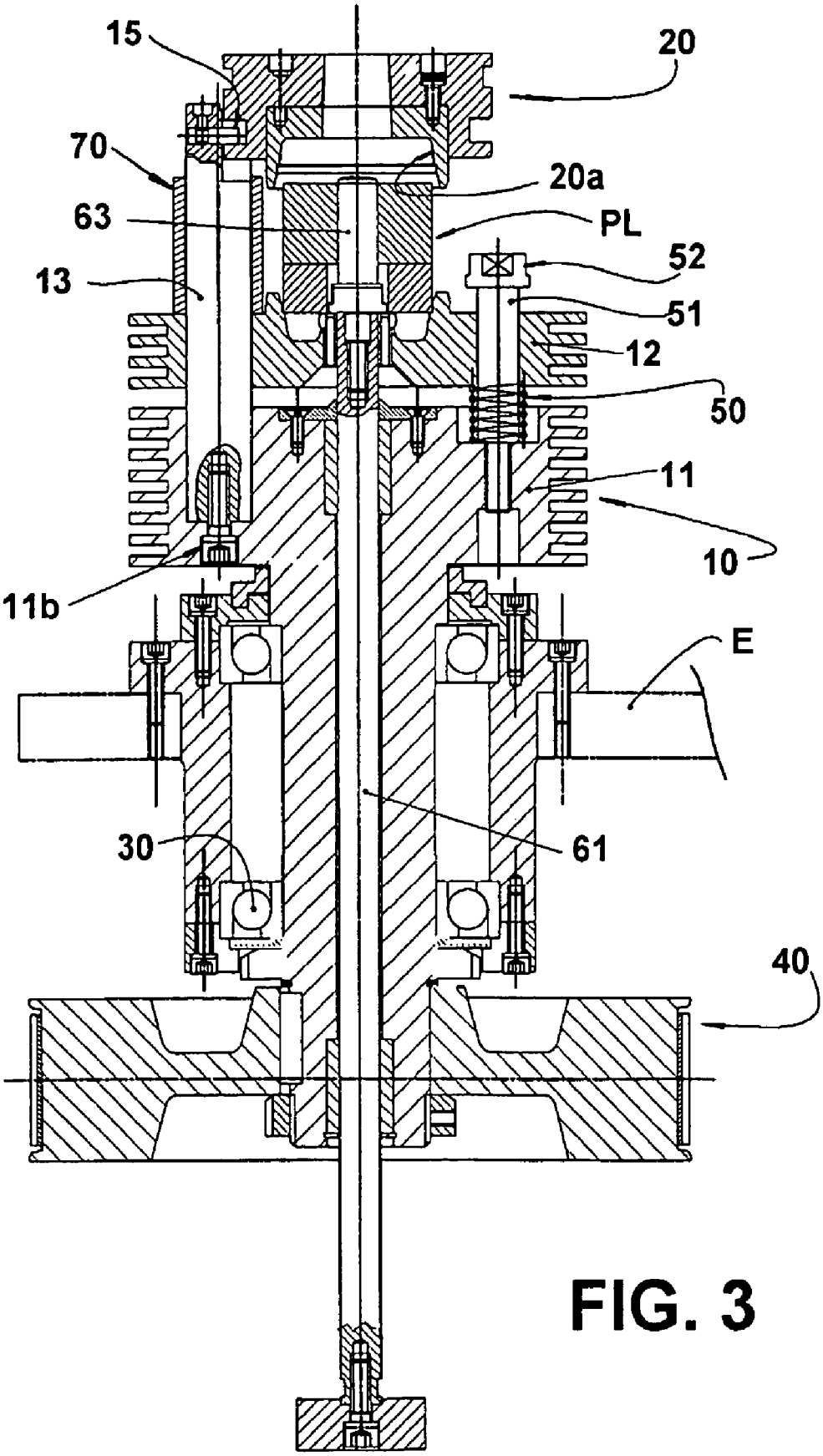
FIG. 3 is a view similar to that of FIG. 2, but illustrating the upper mold portion in axial engagement with the guide means of the axial columns, but still out of its closed mold position and with the moveable block of the lower mold portion being axially displaced to the open mold position.

With the lamination stack PL being positioned on the lower mold cavity 12*a*, the impelling means 60 is driven to cause the downward displacement of the elongated rod 61, whose annular flange 62 causes the corresponding downward displacement of the moveable block 12 of the lower mold portion 10, compressing the elastic means 50 and displacing said moveable block 12 with the lower mold cavity 12*a* toward the open mold position illustrated in FIG. 3. With the lamination stack PL being positioned on the lower mold cavity 12*a* in an open mold condition, the upper mold portion 20 is displaced by any adequate device (not illustrated) to a position that is vertically aligned with the lower mold portion 10 and disposed above the axial columns 13, to be then axially displaced downwards so as to have portions of its lateral surface contacting the respective guide means 14 provided in the axial columns 13, more specifically in an upper end portion of the axial columns 13, as illustrated in FIG. 2. Each guide means 14 is preferably defined by a radially internal end chamfer of the respective axial column 13.

In order to allow the upper mold portion 20 to be correctly and firmly coupled to the axial columns 13, the latter are each provided with a locking means 15, which can take the form of a pin radially projecting from the respective axial column 13 and which is fitted in a lock receiving means 25 provided in the lateral surface of the upper mold portion 20 and which in the illustrated embodiment takes the form of a superficial groove presenting an axial extension for receiving the locking means 15 upon the axial displacement of the upper mold portion 20 in the guide means 14, and a short circumferential extension for receiving the locking means 15 when the upper mold portion 20 in the closed mold position is submitted to a certain rotation around its axis. Fitting the locking means 15 in the circumferential extension of the lock receiving means 25 provides the axial locking of the upper mold portion 20 in the axial columns 13 in the closed mold position.

It should be noted that the downward axial displacement of the upper mold portion 20 along the guide means 14 can be limited by stop means provided in the axial columns 13. In the illustrated embodiment, the stop means are defined by the locking means 15 themselves when they reach the upper end of the axial extension of the lock receiving means 25. However, other arrangements can be provided for the stop means, such as limiting the downward displacement of the device that is responsible for the movement of the upper mold portion 20.

After locking the upper mold portion 20, the impelling means 60 is driven again, to release the moveable block 12 from the lower mold portion 10 and allow it to be axially displaced upwards by action of the elastic means 50, making the lamination stack PL engage the upper mold cavity 20*a*, as illustrated in FIG. 4.

After the injection of the liquid metal through the upper mold portion 20 and after the solidification under centrifugation, the mold is opened according to an inverted sequence of movements, starting with the lower mold cavity 12*a* being displaced downwardly against the action of the elastic means 50 and then by the driving of the impelling means 60.

In order to assure a certain minimum spacing between the two mold cavities 12*a* and 20*a*, when the loading of a lamination stack PL is not taking place, the axial columns 13 may carry a spacer 70, for example in the form of a tubular sleeve provided between the moveable block 12 and the locking means 15 and which will be seated against the two mold portions when the latter reach a certain minimum spacing larger than that corresponding to the respective closed mold positions. Although the invention has been illustrated and described particularly with reference to its preferred embodiment, it should be understood by those skilled in the art that several changes can be made in the form and in details thereof without departing from the spirit and protective scope of the invention.

The invention claimed is:

1. A centrifugation injection mold comprising:

a lower mold portion having a basic block, a lower portion of the basic block being mounted inside of a bearing means and allowed to rotate therein, the bearing means being affixed to a machine structure;

a plurality of axial columns, each axial column having a bottom portion that is affixed around the basic block at an outer portion thereof;

a moveable block defining a lower mold cavity and being mounted to the axial columns, the movable block being able to slide along the axial columns in order to be axially displaced between an open mold position and a closed mold position;

elastic means seated on the basic block and constantly forcing the moveable block to the closed mold position;

a locking means mounted to each axial column; and an upper mold portion removably seated on the axial columns and affixed thereto by the locking means in a closed mold position.

2. The mold according to claim 1, wherein each axial column carries a guide means for receiving, by axial displacement, a corresponding external surface portion of the upper mold portion.

3. The mold according to claim 2, wherein each guide means is defined by a radially internal end chamfer of the respective axial column.

4. The mold according to claim 2, wherein each axial column carries a stop means for limiting said axial displacement of the upper mold portion and defining the closed mold position thereof.

5. The mold according to claim 4, wherein each stop means is defined by a respective locking means.

6. The mold according to claim 2, wherein the upper mold portion is provided with a lock receiving means to be engaged by the locking means of a respective axial column when the upper mold portion is axially slid in the guide means until reaching the closed mold position and slightly rotated around its axis.

7. The mold according to claim 6, wherein each locking means comprises a pin radially projecting from the respective axial column, each lock receiving means being defined by a groove provided in the external surface of the upper mold portion and presenting an axial extension that receives the locking means upon the axial sliding of the upper mold portion in the guide means, and a short circumferential extension that receives the locking means upon the slight rotation of the upper mold portion.

8. The mold according to claim 1, further comprising:

an impelling means operatively associated with the machine structure and with the moveable block and which is selectively driven to displace the moveable block to the open mold position against the action of the elastic means.

9. The mold according to claim 8, wherein the impelling means comprises an elongated rod axially extending through the basic block and the moveable block of the lower mold portion, said elongated rod having an upper end provided with an annular flange to be seated against the central region of the lower mold cavity and a lower end coupled to a driving device to selectively and axially displace the elongated rod.

10. The mold according to claim 9, wherein the upper end of the elongated rod further incorporates an axial extension onto which is tightly fitted a lamination stack.

11. The mold according to claim 1, wherein each axial column carries a spacer that is simultaneously seated against the movable block and the upper mold portion when the movable block and the upper mold portion reach a certain minimum spacing larger than that corresponding to the closed mold position.

* * * * *